US007503787B2

(12) United States Patent
Yu et al.

(10) Patent No.: US 7,503,787 B2
(45) Date of Patent: Mar. 17, 2009

(54) ELECTRICAL CONNECTOR ASSEMBLY HAVING DISTORTION-REDUCTION MECHANISM

(75) Inventors: Wei Yu, ShenZhen (CN); Hao-Yun Ma, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/646,833

(22) Filed: Dec. 27, 2006

(65) Prior Publication Data

US 2007/0184699 A1 Aug. 9, 2007

(30) Foreign Application Priority Data

Dec. 29, 2005 (CN) ..... 2005 2 0140608 U

(51) Int. Cl.
*H01R 13/64* (2006.01)

(52) U.S. Cl. ..... 439/248

(58) Field of Classification Search ..... 439/248, 439/246–247, 630; 361/686, 727
See application file for complete search history.

(56) References Cited

U.S. PATENT DOCUMENTS 6,019,611 A * 2/2000 McHugh et al. ..... 439/71
6,462,954 B1 * 10/2002 Kuo et al. ..... 361/752
6,863,557 B2 * 3/2005 Mills et al. ..... 439/377
7,200,004 B2 * 4/2007 Chen et al. ..... 361/686

* cited by examiner

*Primary Examiner*—Jean F Duverne
(74) *Attorney, Agent, or Firm*—Wei Te Chung

(57) ABSTRACT

An electrical connector assembly (1) includes a circuit substrate (3), a dielectric housing (4) and a number of conductive terminals (5) secured thereto seated on the circuit substrate, an integrated circuit package (6) mounted on the housing, a clamping board (7) positioned on the circuit package and a compliant backboard (2) located beneath the circuit substrate, and a number of screws (8) coupling the clamping board and the backboard to each other. The backboard is formed with a number of protrusions (212) abuttingly urging the circuit substrate toward the housing.

12 Claims, 3 Drawing Sheets

ELECTRICAL CONNECTOR ASSEMBLY HAVING DISTORTION-REDUCTION MECHANISM

BACKGROUND OF THE INVENTION

1. Field of the Invention

The present invention generally relates to the field of electrical connector assemblies. And more particularly, one embodiment of the present invention relates to an electrical connector assembly having distortion-reducing mechanism to reduce distortion of a circuit substrate thereof.

2. General Background

It is known in the art to use a pair of boards and a fastening device to couple an electrical connector and an integrated circuit package to a circuit substrate. As shown in FIG. 1, a prior electrical connector assembly 1' typically includes a circuit substrate 3', a dielectric housing 4' and a number of conductive terminals 5' secured thereto seated on the circuit substrate 3', and an integrated circuit package 6' mounted on the housing 4'. The housing 4' and the integrated circuit package 6' are sandwiched between a clamping board 7' placed on the circuit package 6' and a compliant backboard 2' beneath the circuit substrate 3' via a number of screws 8', so as to retain electrical connection between the integrated circuit package 6' and the circuit substrate 3'.

However, in this prior design, the circuit substrate 3' is likely to warp under tightening force of the screws 8', which may lead to the conductive terminals 5' disengaging from the circuit substrate 3' and adversely affect electrical interconnection between the integrated circuit package 6' and the circuit substrate 3'.

Therefore, there is a heretofore unaddressed need in the industry to address the aforementioned deficiencies and inadequacies.

SUMMARY

According to an embodiment of the present invention, an electrical connector assembly includes a circuit substrate, a dielectric housing and a number of conductive terminals secured thereto seated on the circuit substrate, an integrated circuit package mounted on the housing, a clamping board positioned on the circuit package and a compliant backboard beneath the circuit substrate, and a number of screws coupling the clamping board to the backboard. The backboard is formed with a number of protrusions abuttingly urging the circuit substrate toward the housing.

The electrical connector assembly according to the embodiment of the present invention includes a backboard formed with a number of protrusions. The protrusions can abuttingly urge the circuit substrate toward the housing, which may exert a force on the circuit substrate under tightening force of the screws and therefore reduce distortion of the circuit substrate.

The present invention is illustrated by way of example and not limitation in the figures of the appended drawings, in which like references indicate identical elements, and in which:

DETAILED DESCRIPTION OF THE EMBODIMENT

In the following description, for purpose of explanation, numerous details are set forth in order to provide a thorough understanding of the embodiment of the present invention. However, it will be apparent to one skilled in the art that these specific details are not required in order to practice the embodiment of the present invention.

Figure 1:
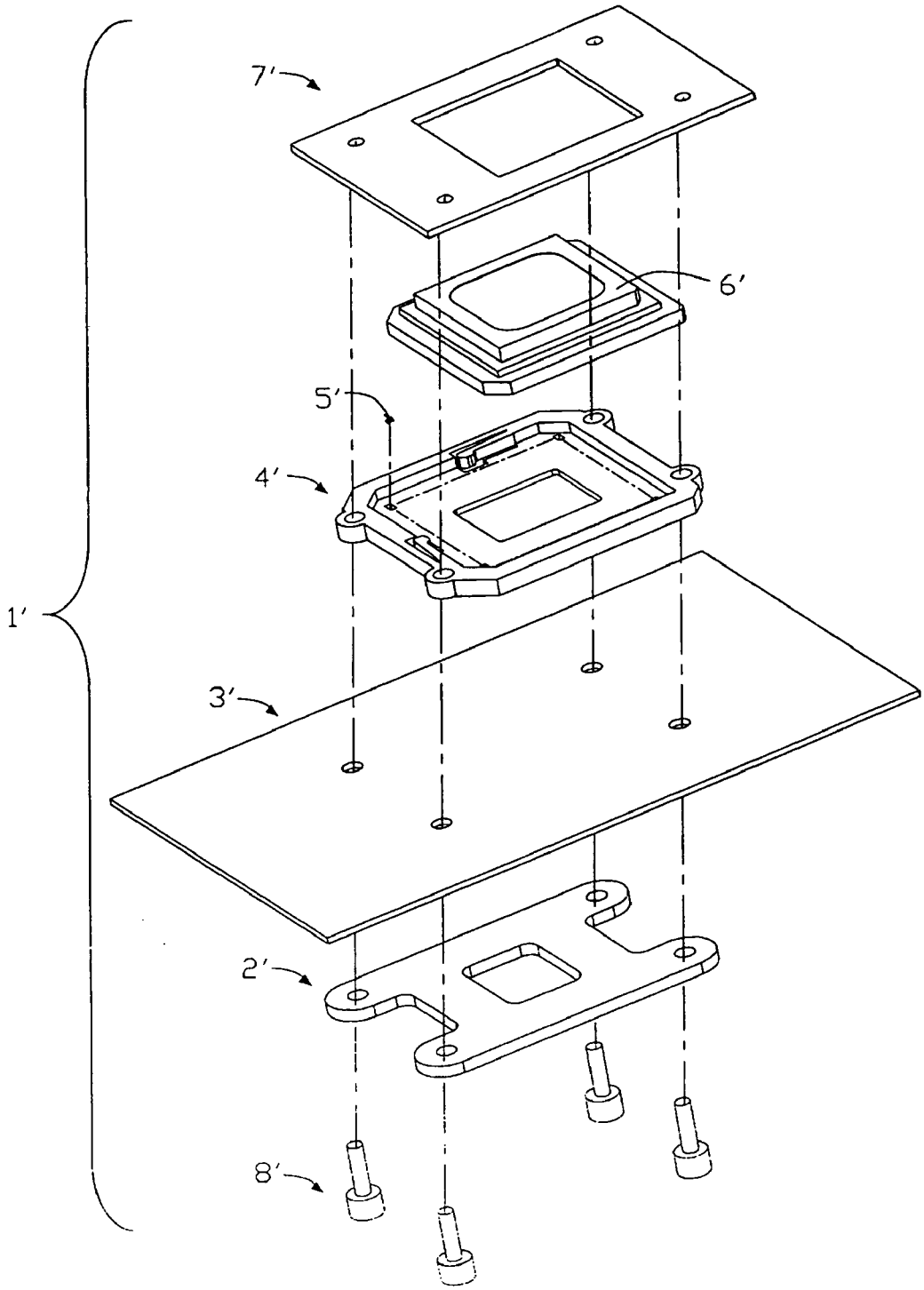
FIG. 1 (Prior Art)
FIG. 1 depicts an exemplary exploded view of an electrical connector assembly according to a prior design.
Figure 2:
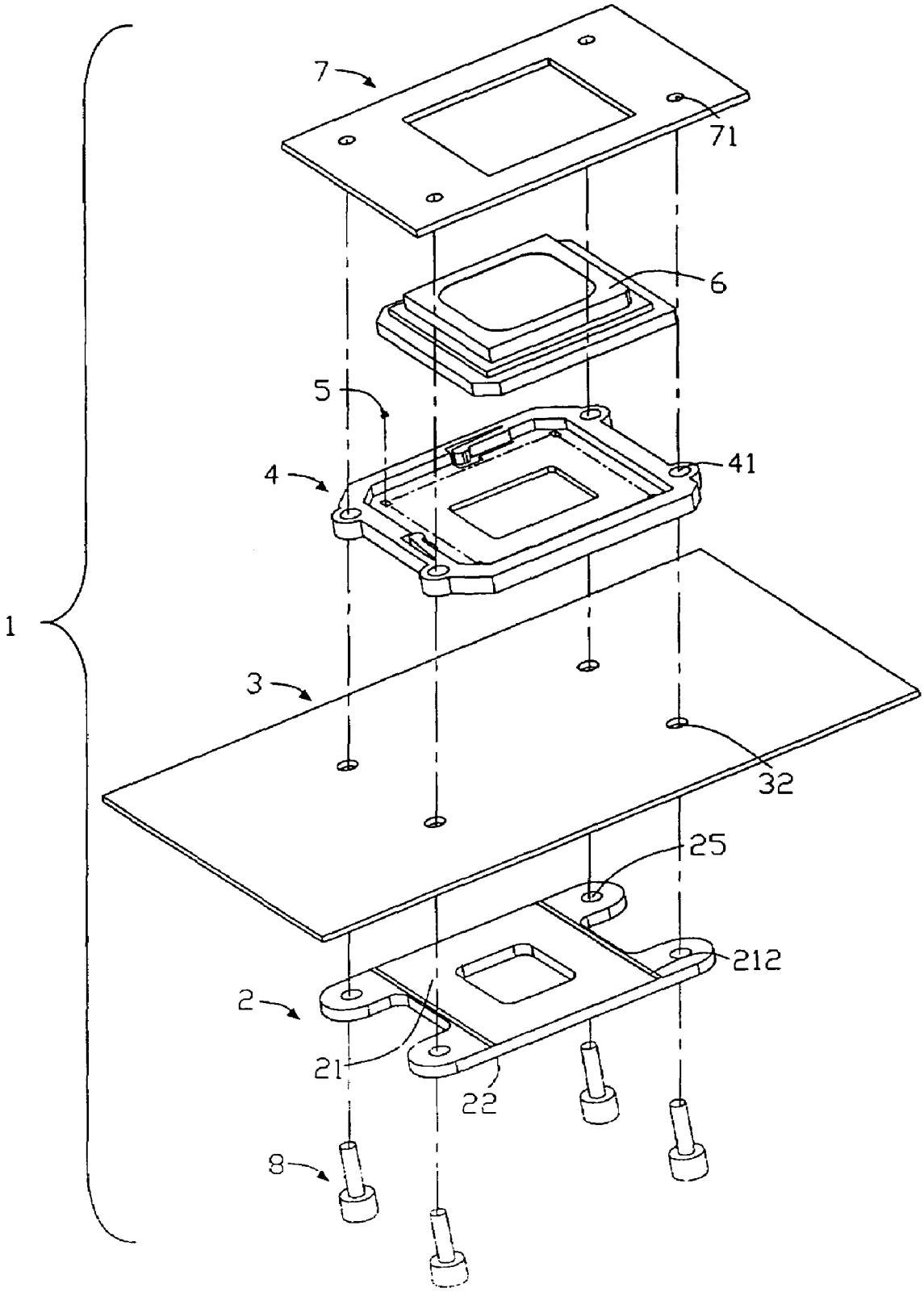
FIG. 2 depicts an exemplary exploded view of an electrical connector assembly in accordance with an embodiment of the present invention.
Figure 3:
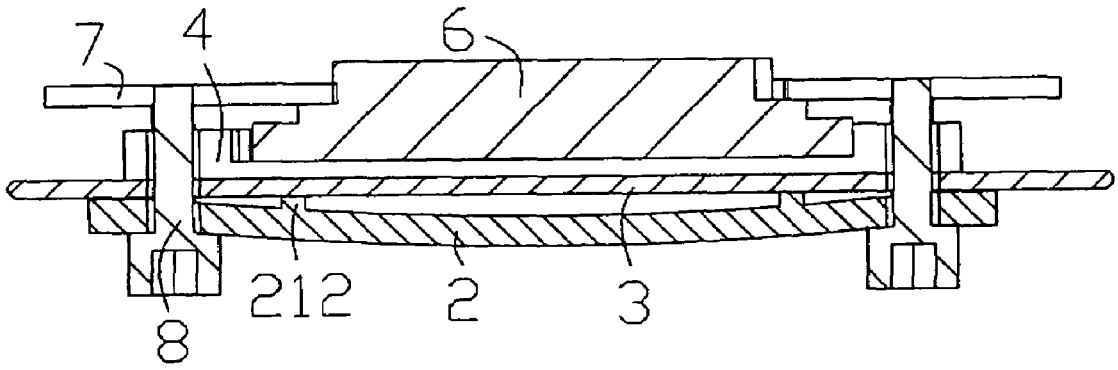
FIG. 3 depicts an exemplary assembled, cross-sectional view of the electrical connector assembly shown in FIG. 2.

Referring to FIG. 2 and FIG. 3, an electrical connector assembly 1 according to an embodiment of the present invention includes a circuit substrate 3, a dielectric housing 4 and a number of conductive terminals 5 secured thereto positioned on the circuit substrate 3, an integrated circuit package 6 mounted on the housing 4, a clamping board 7 placed on the integrated circuit package 6 and a compliant backboard 2 located beneath the circuit substrate 3, and a number of screws 8 coupling the clamping board 7 and the backboard 2 to each other. The backboard 2 is provided with a number of protrusions 212 abuttingly urging the circuit substrate 3 toward the housing 4.

As best shown in FIG. 2, the backboard 2 includes an upper face 21 facing the circuit substrate 3 and an opposite lower surface 22. A number of upwardly extending protrusions 212 is integrally formed from the upper surface 22 of the backboard 2. Each protrusion 212 is continuously distributed on the backboard 2. It should be understood that in an alternative form of the present embodiment, the protrusions 212 could also be discretely distributed on the backboard 2.

As shown in FIG. 2 and FIG. 3, in assembly, the housing 4 and the conductive terminals 5 secured thereto are suitably seated on the circuit substrate 3, with lower ends (not labeled) of the conductive terminals 5 electrically connected to the circuit substrate 3. The integrated circuit package 6 is mounted on the housing 4, with a bottom face thereof being in electrical contact with upper ends (not labeled) of the conductive terminal 5. The clamping board 7 is placed on a top face of the integrated circuit package 6. The backboard 2 is situated beneath the circuit substrate 3.

Screws 8 each successively run through a through-hole 25 in the backboard 2, a mounting hole 32 in the circuit substrate 3 and an aperture 71 in the clamping board 7. In an alternative form of the present embodiment, the screw 8 can also run through a positioning hole 41 defined proximal to two opposing sides of the housing 4 to couple the housing 4 to the circuit substrate 3 more securely. In this manner, the protrusions 212 are situated close to the opposing sides of the housing 4 symmetrically.

In connection with the preceding description, the backboard 2 of the electrical connector assembly 1 in accordance with the present embodiment provides a number of protrusions 212 extending upwardly. When the screws 8 are fastened, the clamping board 7 and the backboard 2 move toward each other. The protrusions 212 abuttingly urge the circuit substrate 3 toward the housing 4, which can exert a force on the circuit substrate 3 in response to a force from the screws 8 on the backboard 2 and reduce distortion of the circuit substrate 3.

While the present invention has been illustrated by description of embodiment thereof, and while the embodiment have been described in considerable detail, it is not intended to restrict or in any way limit the scope of the appended claims to such details. Additional advantages and modifications in the spirit and scope of the present invention will readily appear to one skilled in the art. Therefore, the present invention is not limited to the specific details and illustrative examples shown and described.

The invention claimed is:

1. An electrical connector assembly comprising:

a printed circuit board defining opposite first and second surfaces;

an electrical connector mounted on the first surface;

a reinforcement compliant board mounted on the second surface;

securing devices located around a periphery of the connector and forcing the reinforcement board toward to the printed circuit board;

at least one protrusion formed on the reinforcement board to abut against the second surface at a position essentially vertically aligned with a primary region of the connector; wherein the reinforcement compliant board is curved away from the printed circuit board duet o said protrusion; wherein a distance between a central region of the reinforcement compliant board and the printed circuit board is larger than that between a periphery region of the reinforcement compliant board and the printed circuit board.

2. The assembly as claimed in claim 1, further including a clamping board cooperating with the reinforcement compliant board to tightly sandwich the connector and the printed circuit board therebetween.

3. The assembly as claimed in claim 1, wherein said securing devices are screws.

4. The assembly as claimed in claim 1, wherein said protrusion is located inside of said securing devices.

5. The assembly as claimed in claim 1, wherein the protrusion is not vertically aligned with either securing devices.

6. An electrical connector assembly comprising:

a printed circuit board defined opposite first and second surfaces;

an electronic component mounted on the first surface; and a reinforcement compliant board mounted on the second surface and defining thereof a protrusion facing the second surface; wherein the reinforcement compliant board and the printed circuit board arc fastened in a tensioned manner, and said protrusion strongly abuts against the second surface to strengthen tension therebetween; wherein the reinforcement compliant board is curved away from the printed circuit board due to said protrusion; wherein a distance between a central region of the reinforcement compliant board and the printed circuit board is larger than that between a periphery region of the reinforcement compliant board and the printed circuit board.

7. The assembly as claimed in claim 6, wherein the protrusion is located around a position essentially vertically aligned with a primary region of the component.

8. The assembly as claimed in claim 6, further including a clamping board above the first surface to cooperate with the reinforcement compliant board to tightly sandwich the component and the printed circuit board therebetween.

9. The assembly as claimed in claim 6, wherein there are two protrusions in a symmetrical arrangement with the reinforcement compliant board.

10. The assembly as claimed in claim 6, wherein said protrusion is unitarily formed on the reinforcement compliant board.

11. The assembly as claimed in claim 6, wherein said protrusion is in tensional sandwiched between the reinforcement compliant board and the printed circuit board.

12. The assembly as claimed in claim 6, further comprising fastening devices to fasten the printed circuit board and the reinforcement compliant board together, and said fastening devices are not vertical aligned with the protrusion so as to make the reinforcement compliant board curved.

* * * * *